US006420328B1

(12) United States Patent
Gorlin

(10) Patent No.: US 6,420,328 B1
(45) **Date of Patent: *Jul. 16, 2002**

(54) PINK COLORED, AQUEOUS LIQUID AUTOMATIC DISHWASHER DETERGENT COMPOSITION

(75) Inventor: Philip Gorlin, Flemington, NJ (US)

(73) Assignee: Colgate-Palmolive Co., Piscataway, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/772,335

(22) Filed: Jan. 26, 2001

Related U.S. Application Data

(63) Continuation-in-part of application No. 09/670,208, filed on Sep. 25, 2000.

(51) Int. Cl.[7] ..... C11D 1/22; C11D 3/065; C11D 3/08; C11D 3/37

(52) U.S. Cl. ..... 510/223; 510/228; 510/230; 510/231; 510/232; 510/233; 510/380; 510/477; 510/488; 510/512

(58) Field of Search ..... 510/221, 223, 510/228, 230, 231, 232, 233, 380, 477, 488, 512

(56) References Cited

U.S. PATENT DOCUMENTS

| | | | | | |
|---|---|---|---|---|---|
| 5,225,096 | A | * | 7/1993 | Ahmed et al. | 510/223 |
| 5,252,242 | A | * | 10/1993 | Shevade et al. | 510/223 |
| 5,395,547 | A | * | 3/1995 | Broadwell et al. | 510/223 |
| 5,413,727 | A | * | 5/1995 | Drapier et al. | 510/223 |
| 5,427,707 | A | * | 6/1995 | Drapier et al. | 510/222 |
| 5,510,047 | A | * | 4/1996 | Gabriel et al. | 510/221 |
| 5,929,008 | A | * | 7/1999 | Goldstein | 510/221 |

* cited by examiner

*Primary Examiner*—Gregory Delcotto
(74) *Attorney, Agent, or Firm*—Richard Enanfeld

(57) ABSTRACT

A pink colored automatic dishwasher detergent composition is formulated as a gel-like aqueous product of exceptionally good physical stability, low bottle residue, low cup leakage, red color stability and improved cleaning performance.

2 Claims, No Drawings

PINK COLORED, AQUEOUS LIQUID AUTOMATIC DISHWASHER DETERGENT COMPOSITION

RELATED APPLICATION

This application is a continuation-in-part application of U.S. Ser. No. 09/670,208 filed Sep. 25, 2000 allowed.

FIELD OF INVENTION

The present invention relates generally to an automatic dishwasher detergent composition in the form of an aqueous liquid, wherein the composition is pink in color.

BACKGROUND OF THE INVENTION

Liquid automatic dishwasher detergent compositions, both aqueous and nonaqueous, have recently received much attention, and the aqueous products have achieved commercial popularity.

The acceptance and popularity of the liquid formulations as compared to the more conventional powder products stems from the convenience and performance of the liquid products. However, even the best of the currently available liquid formulations still suffer from two major problems, product phase instability and bottle residue, and to some extent cup leakage from the dispenser cup of the automatic dishwashing machine as well as unacceptable color appearance.

Representative of the relevant patent art in this area, mention is made of Rek, U.S. Pat. No. 4,556,504; Bush, et al., U.S. Pat. No. 4,226,736; Ulrich, U.S. Pat. 4,431,559; Sabatelli, U.S. Pat. No. 4,147,650; Paucot, U.S. Pat. No. 4,079,015; Leikhem, U.S. Pat. No. 4,116,849; Milora, U.S. Pat. No. 4,521,332; Jones, U.S. Pat. No. 4,597,889; Heile, U.S. Pat. No. 4,512,908; Laitem, U.S. Pat. No. 4,753,748; Sabatelli, U.S. Pat. No. 3,579,455; Hynam, U.S. Pat. No. 3,684,722: other patents relating to thickened detergent compositions include U.S. Pat. No. 3,985,668; U.K. Pat. No. Applications GB 2,116,199A and GB 240,450A; U.S. Pat. No. 4,511,487; U.S. Pat. No. 4,752,409 (Drapier, et al.); U.S. Pat. No. 4,801,395 (Drapier, et al.); U.S. Pat. No. 4,801,395 (Drapier, et al.).

All of the prior art examples are yellow in yellow. The instant compositions are bleach stable and pink in appearance.

SUMMARY OF THE INVENTION

According to the present invention there is provided a novel aqueous liquid automatic dishwasher detergent composition which is pink in color and bleach stable. The composition is characterized by its substantially indefinite stability against phase separation or settling of dissolved or suspended particles, low levels of bottle residue, relatively high bulk density, a pink colored composition which is stable in the presence of bleach and substantial absence of unbound or free water. This unique combination of properties is achieved by virtue of the incorporation into the aqueous mixture of dishwashing detergent surfactant, optionally, an alkali metal detergent builder salt(s), chlorine bleach compound, an effective amount of high molecular weight cross-linked polyacrylic acid type thickening agent; a physical stabilizing amount of a long chain fatty acid or salt thereof; optionally, a noncrosslinked polyacrylate type polymer and a bleach stable red colorant thereby forming a pink colored liquid gelled automatic dishwashing composition. The compositions are further characterized by a bulk density of at least 1.24 g/cc, such that the density of the polymeric phase and the density of the aqueous (continuous) phase are approximately the same.

DETAILED DESCRIPTION OF THE PREFERRED EMBODIMENTS

The compositions of this invention are pink colored, aqueous liquids containing various cleansing active ingredients, detergent adjuvants, structuring and thickening agents and stabilizing components, although some ingredients may serve more than one of these functions.

The advantageous characteristics of the compositions of this invention, including a bleach stable pink color physical stability, low bottle residue, high cleaning performance, e.g. low spotting and filming, food removal, and so on, and superior aesthetics, are believed to be attributed to several interrelated factors such as low solids, i.e. undissolved particulate content, product density and linear viscoelastic rheology. These factors are, in turn, dependent on several critical compositional components of the formulations, namely, (1) the inclusion of a thickening effective amount of polymeric thickening agent having high water absorption capacity, exemplified by high molecular weight cross-linked polyacrylic acid, (2) inclusion of a physical stabilizing amount of a long chain fatty acid or salt thereof, (3) a product bulk density of at least 1.24 g/cc, such that the bulk density and liquid phase density are about the same.

The pink colored, liquid gelled automatic dishwashing composition comprises approximately by weight:

(a) 0.1% to 55%, more preferably 5% to 40% of an inorganic compound containing alkali metal cations, preferably sodium ions, wherein said inorganic compound is selected from the group consisting of alkali metal detergent builder salts, alkali metal hydroxides and alkali metal silicates and mixtures thereof;

(b) 0.1% to 5% of at least one chlorine bleach stable, water-dispersible organic detergent active material;

(c) 0 to 2%, more preferably 0.05% to 1.75% chlorine bleach stable foam depressant;

(d) at least one chlorine bleach compound in an amount to provide about 0.2% to 4% of available chlorine;

(e) 0.1% to 2.5%, more preferably 0.2% to 1.5% of a high molecular weight hydrophilic cross-linked polyacrylic acid thickening agent;

(f) 0 to 5%, more preferably 0. 1% to 4.0% of a low molecular weight non-crosslinked polyacrylate-type polymer;

(g) 0 to 2%, more preferably 0.05% to 1% of a long chain fatty acid or a metal salt of a fatty acid;

(h) 0.001% to 0.5%, more preferably 0.001% to 0.2% of a F203 C.l. Pigment Red 1010 colorant; and (i) the balance being water, wherein the composition is pink in color and has chromaticity coordinate values of x from about 0.3142 to about 0.3300 and, more preferably about 0.3162 to about 0.3290 and y from about 0.3233 to about 0.3450, more preferably 0.3253 to 0.3425. The x and y values were obtained from the tristimulus values (x, y and z) obtained from measurements made using a QA Master spherical spectrophotometer (X-Rite Corp.), 10 degree observer, D65 illuminant at 25° C. and calibrated BTILL=barium sulfate, reflectance mode, specular component included, UV component included, large area view (sample and lens). CIELAB coordinates in the CIELAB system for the composition are (a) equals from about 1.25 to about 1.75, more preferably about 1.30 to about 1.64 and (b) from about −0.1 to about +4.0, more preferably from about −0.05 to about +3.5; L is about 28 to about 40, more preferably about 30 to about 39, C is about 1.0 to about 4, more preferably about 1.25 to about 3.75 and h is about −0.1 to about +0.1, more preferably about −0.05 to about +0.05.

Exemplary of the cross-linked polyacrylic acid-type thickening agents are the products sold by B.F. Goodrich under their Carbopol trademark, especially Carbopol 941, which is the most ion-insensitive of this class of polymers, and Carbopol 940 and Carbopol 934. The Carbopol resins, also known as "Carbomer", are hydrophilic high molecular weight, cross-linked acrylic acid polymers having an average equivalent weight of 76, and the general structure illustrated by the following formula:

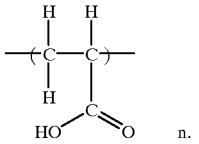

Carbopol 941 has a molecular weight of 1,250,000; Carbopol 940 a molecular weight of approximately 4,000,000 and Carbopol 934 a molecular weight of approximately 3,000,000. The Carbopol resins are cross-linked with polyalkenyl polyether, e.g. 1% of a polyallyl ether of sucrose having an average of 5.8 allyl groups for each molecule of sucrose. Further detailed information on the Carbopol resins is available from B.F. Goodrich, see, for example, the B.F. Goodrich catalog GC-67, Carbopol® Water Soluble Resins.

While most favorable results have been achieved with Carbopol 614 or 617 from BF Goodrich or the Polygel series from 3V Company, preferably Polygel TL, other lightly cross-linked polyacrylic acid-type thickening agents can also be used in the compositions of this invention. As used herein "polyacrylic acid-type" refers to water-soluble homopolymers of acrylic acid or methacrylic acid or water-dispersible or water-soluble salts, esters or amides thereof, or water-soluble copolymers of these acids of their salts, esters or ameides with each other or with one or more other etylenically unsaturated monomers, such as, for example, styrene, maleic acid, maleic anhydride, 2-hydroxyethylacrylate, acrylonitrile, vinyl acetate, ethylene, propylene, and the like.

These homopolymers or copolymers are characterized by their high molecular weight, in the range of from about 500,000 to 10,000,000, preferably 500,000 to 5,000,000, especially from 1,000,000 to 4,000,000, and by their water solubility, generally at least to an extent of up to 5% by weight, or more, in water at 250° C.

These thickening agents are used in their lightly cross-linked form wherein the cross-linking may be accomplished by means known in the polymer arts, as by irradiation, or, preferably, by the incorporation into the monomer mixture to be polymerized of known chemical cross-linking monomeric agents, typically polyunsaturated (e.g. diethylenically unsaturated) monomers, such as, for example, divinylbenzene, divinylether of diethylene glycol, N, N'-methylene-bisacrylamide, polyalkenylpolyethers (such as described above), and the like. Typically, amounts of cross-linking agent to be incorporated in the final polymer may range from about 0.01 to about 1.5 percent, preferably from about 0.05 to about 1.2 percent, and especially, preferably from about 0.1 to about 0.9 percent, by weight of cross-linking agent to weight of total polymer. Generally, those skilled in the art will recognize that the degree of cross-linking should be sufficient to impart some coiling of the otherwise generally linear polymeric compound while maintaining the cross-linked polymer at least water dispersible and highly water-swellable in an ionic aqueous medium. It is also understood that the water-swelling of the polymer which provides the desired thickening and viscous properties generally depends on one or two mechanisms, namely, conversion of the acid group containing polymers to the corresponding salts, e.g. sodium, generating negative charges along the polymer backbone, thereby causing the coiled molecules to expand and thicken the aqueous solution; or by formation of hydrogen bonds, for example, between the carboxyl groups of the polymer and hydroxyl donor. The former mechanism is especially important in the present invention, and therefore, the preferred polyacrylic acid-type thickening agents will contain free carboxylic acid (COOH) groups along the polymer backbone. Also, it will be understood that the degree of cross-linking should not be so high as to render the cross-linked polymer completely insoluble or non-dispersible in water or inhibit or prevent the uncoiling of the polymer molecules in the presence of the ionic aqueous system.

The amount of the high molecular weight, cross-linked polyacrylic acid or other high molecular weight, hydrophilic cross-linked polyacrylic acid-type thickening agent to impart the desired Theological property of linear viscoelasticity will generally be in the range of from about 0.1 to 2.5%, preferably from about 0.2 to 1.5%, by weight, based on the weight of the composition, although the amount will depend on the particular cross-linking agent, ionic strength of the composition, hydroxyl donors and the like.

Specific examples of the alkali metal detergent builder salts include the polyphosphates, such as alkali metal pyrophosphate, alkali metal tripolyphosphate, alkali metal metaphosphate, and the like, for example, sodium or potassium tripolyphosphate (hydrated or anhydrous), tetrasodium or tetrapotassium pyrophosphate, sodium or potassium hexa-metaphosphate, trisodium or tripotassium orthophosphate and the like, sodium or potassium carbonate, sodium or potassium citrate, sodium or potassium nitrilotriacetate, and the like. The phosphate builders, where not precluded due to local regulations, are preferred and mixtures of tetrapotassium pyrophosphate (TKPP), potassium tripolyphosphate (KTPP), and sodium tripolyphosphate (NaTPP) (especially the hexahydrate) are especially preferred. Typical ratios of NaTPP to TKPP are from about 2:1 to 1:8, especially from about 1:1.1 to 1:6. The total amount of detergent builder salts is preferably from about 2 to 15%.

The gelled compositions of this invention may, contain a small, but stabilizing effective amount of a long chain fatty acid or monovalent or polyvalent salt thereof. Although the manner by which the fatty acid or salt contributes to the rheology and stability of the composition has not been fully elucidated it is hypothesized that it may function as a hydrogen bonding agent or cross-linking agent for the polymeric thickener. The preferred long chain fatty acids are the higher aliphatic fatty acids having from about 8 to 22 carbon atoms, more preferably from about to carbon atoms, and especially preferably from about 12 to 18 carbon atoms, and especially preferably from 12 to 18 carbon atoms, inclusive of the carbon atom of the carboxyl group of the fatty acid. The aliphatic radical may be saturated or unsaturated and may be straight or branched. Straight chain saturated fatty acids are preferred. Mixtures of fatty acids may be used, such as those derived from natural sources, such as tallow fatty acid, coco fatty acid, soya fatty acid, mixtures of these acids, etc. Stearic acid and mixed fatty acids, e.g. stearic acid/palmitic acid, are preferred.

Thus, examples of the fatty acids include, for example, decanoic acid, dodecanoic acid, palmitic acid, myristic acid, stearic acid, behenic acid, oleic acid, eicosanoic acid, tallow fatty acid, coco fatty acid, soya fatty acid, mixtures of these acids, etc. Stearic acid and mixed fatty acids, e.g. stearic acid/palmitic acid, are preferred.

When the free acid form of the fatty acid is used directly it will generally associate with the potassium and sodium ions in the aqueous phase to form the corresponding alkali metal fatty acid soap. However, the fatty acid salts may be directly added to the composition as sodium salt or potassium salt, or as a polyvalent metal salt, although the alkali metal salts of the fatty acids are preferred fatty acid salts.

The preferred polyvalent metals are the di- and tri-valent metals of Groups IIA, IIB and IIIB, such as magnesium, calcium, aluminum and zinc, although other polyvalent metals, including those of Groups IIIA, IVA, VA, IB, IVB, VB VIB, VIIB and VIII of the Periodic Table of the Elements can also be used. Specific examples of such other polyvalent metals include Ti, Zr, V, Nb, Mn, Fe, Co, Ni, Cd, Sn, Sb, Bi, etc. Generally, the metals may be present in the divalent to pentavalent state. Preferably the metal salts are used in their higher oxidation states. Naturally, for use in automatic dishwashers, as well as any other applications where the invention composition will or may come in contact with articles used for the handling, storage or serving of food products or which otherwise may come into contact with or be consumed by people or animals, the metal salt should be selected by taking into consideration the toxicity of the metal. For this purpose, the alkali metal and calcium and magnesium salts are especially higher preferred as generally safe food additives.

The amount of the fatty acid or fatty acid salt stabilizer to achieve the desired enhancement of physical stability will depend on such factors as the nature of the fatty acid or its salt, the nature and amount of the thickening agent, amount of the acidic sol of the alumina, detergent active compound, inorganic salts, other ingredients, as well as the anticipated storage and shipping conditions.

Generally, however, amounts of the fatty acid or fatty acid salt stabilizing agents in the range of from about 0 to 2%, preferably 0.05 to 1%, more preferably from about 0.08 to 0.8% provide a long term stability and absence of phase separation upon standing or during transport at both low and elevated temperatures as are required for a commercially acceptable product.

Depending on the amounts, proportions and types of fatty acid physical stabilizers, the amount of the acidic sol of the alumina and polyacrylic acid-type thickening agents, the addition of the fatty acid or salt not only increases physical stability but also provides a simultaneous increase in apparent viscosity.

Foam inhibition is important to increase dishwasher machine efficiency and minimize destabilizing effects which might occur due to the presence of excess foam within the washer during use. Foam may be reduce by suitable selection of the type and/or amount of detergent active material, the main foam-producing component. The degree of foam is also somewhat dependent on the hardness of the wash water in the machine whereby suitable adjustment of the proportions of the builder salts such as NaTPP which has a water softening effect, may aid in providing a degree of foam inhibition. However, it is generally preferred to include a chlorine bleach stable foam depressant or inhibitor. Particularly effective are the alkyl phosphoric acid esters of the formula

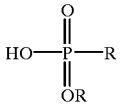

and especially the alkyl acid phosphate esters of the formula

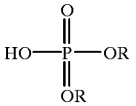

In the above formulas, one or both R groups in each type of ester may represent independently a $C_{12}$–$C_{20}$ alkyl or ethoxylated alkyl group. The ethoxylated derivatives of each type of ester, for example, the condensation products of one mole of ester with from 1 to moles, preferably 2 to 6 moles, more preferably 3 or 4 moles, ethylene oxide can also be used. Some examples of the foregoing are commercially available, such as the products SAP from Hooker and LPKN158 from Clariant. Mixtures of the two types, or any other chlorine bleach stable types, or mixtures of mono- and di-esters of the same type, may be employed. Especially preferred is a mixture of mono- and di-$C_{16}$–$C_{18}$ alkyl acid phosphate esters such as monostearyl/distearyl acid phosphates 1.2/1, and the 3 to 4 mole ethylene oxide condensates thereof. When employed, proportions of 0.05 to 2.0 weight percent, preferably 0.1 to 0.5 weight percent, of foam depressant in the composition is typical, the weight ratio of detergent active component (d) to foam depressant (e) generally ranging from 10:1 to 1:1 and preferably 5:1 to 1:1. Other defoamers which may be used include, for example, the known silicones, such as available from Dow Chemicals. In addition, it is an advantageous feature of this invention that many of the stabilizing salts, such as the stearate salts, for example, aluminum stearate, when included, are also effective as foam killers.

Although any chlorine bleach compound may be employed in the compositions of this invention, such as dichloro-isocyanurate, dichloro-dimethyl hydantoin, or chlorinated TSP, alkali metal or alkaline earth metal, e.g. potassium, lithium, magnesium and especially sodium, hypochlorite is preferred. The composition should contain sufficient amount of chlorine bleach compound to provide about 0.2 to 4.0% by weight of available chlorine, as determined, for example by acidification of 100 parts of the composition with excess hydrochloric acid. A solution containing about 0.2 to 4.0% by weight of sodium hypochlorite contains or provides roughly the same percentage of available chlorine. About 0.8 to 1.6% by weight of available chlorine is especially preferred. For example, sodium hypochlorite (NaOCl) solution of from about 11 to about 13% available chlorine in amounts of about 3 to 20%, preferably about 7 to 12%, can be advantageously used.

Detergent active material useful herein should be stable in the presence of chlorine bleach, especially hypochlorite bleach, and for this purpose those of the organic anionic, amine oxide, phosphine oxide, sulphoxide or betaine water dispersible surfactant types are preferred, the first mentioned anionics being most preferred. Particularly preferred surfactants herein are the linear or branched alkali metal mono- and/or di-($C_8$–$C_{14}$) alkyl diphenyl oxide mono- and/or di-sulphates, commercially available for example as DOW- FAX (registered trademark) 3B-2 and DOWFAX 2A-1. In addition, the surfactant should be compatible with the other ingredients of the composition. Other suitable organic anionic, non-soap surfactants include the primary alkylsulphates, alkylsulphonates, alkylarylsulphonates and sec.-alkylsulphates. Examples include sodium $C_{10}$–$C_{18}$ alkylsulphates such as sodium dodecylsulphate and sodium tallow alcoholsulphate; sodium $C_{10}$–$C_{18}$ alkanesulphonates such as sodium hexadecyl-1-sulphonate and sodium $C_{12}$–$C_{18}$ alkylbenzenesulphonates such as sodium dodecylbenzenesylphonates. The corresponding potassium salts may also be employed.

As other suitable surfactants or detergents, the amine oxide surfactants are typically of the structure $R_2R_1$ NO, in which each R represents a lower alkyl group, for instance, methyl, and $R^1$ represents a long chain alkyl group having from 8 to 22 carbon atoms, for instance a lauryl, myristyl, palmityl or cetyl group. Instead of an amine oxide, a corresponding surfactant phosphine oxide $R_2R^1$ PO or sulphoxide $RR^1SO$ can be employed. Betaine surfactants are typically of the structure $R_2R_1N$+RCOO-, in which each R represents a lower alkylene group having from 1 to 5 carbon atoms. Specific examples of these surfactants include lauryl-dimethylamine oxide, myristyl-dimethylamine oxide, myristyl-dimethylamine oxide, the corresponding phosphine oxides and sulphoxides, and the corresponding betaines, including dodecyidimethylammonium acetate, tetradecyidiethylammonium pentanoate, hexadecyldimethylammonium hexanoate and the like. For biodegradability, the alkyl groups in these surfactants should be linear, and such compounds are preferred.

Surfactants of the foregoing type, all well known in the art, are described, for example, in U.S. Pat. Nos. 3,985,668 and 4,271,030. If chlorine bleach is not used than any of the well known low-foaming nonionic surfactants such as alkoxylated fatty alcohols, e.g. mixed ethylene oxide-propylene oxide condensates of $C_8$–$C_{22}$ fatty alcohols can also be used.

The chlorine bleach stable, water dispersible organic detergent-active material (surfactant) will normally be present in the composition in minor amounts, generally about 1% by weight of the composition, although smaller or larger amounts, such as up to about 5%, such as from 0.1 to 5%, preferably form 0.3 or 0.4 to 2% by weight of the composition, may be used.

Alkali metal (e.g. potassium or sodium) silicate, which provides alkalinity and protection of hard surfaces, such as fine china glaze and pattern, is generally employed in an amount ranging from about to weight percent, preferably about 5 to 15 weight percent, more preferably 8 to 12% in the composition. The sodium or potassium silicate is generally added in the form of an aqueous solution, preferably having $Na_2O:SiO_2$ or $K_2O:SiO_2$ ratio of about 1:1.3 to 1:2.8, especially preferably 1:2.0 to 1:2.6. At this point, it should be mentioned that many of the other components of this composition, especially alkali metal hydroxide and bleach, are also often added in the form of a preliminary prepared aqueous dispersion or solution.

In addition to the detergent active surfactant, foam inhibitor, alkali metal silicate corrosion inhibitor, and detergent builder salts, which all contribute to the cleaning performance, it is also known that the effectiveness of the liquid automatic dishwasher detergent compositions is related to the alkalinity, and particularly to moderate to high alkalinity levels. Accordingly, the compositions of this invention will have pH values of at least about 9.5, preferably at least about 11 to as high as 14, generally up to about 13 or more, and, when added to the aqueous wash bath at a typical concentration level of grams per liter, will provide a pH in the wash bath of at least 9, preferably at least about 10, such as 10.5, 11, 11.5 or 12 or more.

The alkalinity will be achieved, in part by the alkali metal ions contributed by the alkali metal detergent builder salts, e.g. sodium tripolyphosphate, tetrapotassium pyrophosphate, and alkali metal silicate, however, it is usually necessary to include at least alkali metal hydroxide, e.g. NaOH or KOH, to achieve the desired high alkalinity.

Other alkali metal salts, such as alkali metal carbonate may also be present in the compositions in minor amounts, for example from 0 to 4%, preferably 0.1 to 2%, by weight of the composition.

The preferred low molecular noncrosslinked polyacrylate polymer is an alkali metal salt such as sodium of a noncrosslinked polyacrylic acid homopolymer having a molecular weight of about 1,000 to about 20,000, preferably about 2,000 to about 4,000. A preferred polymer is Aucsol™ 445N sold by Rohm Haas which has a molecular weight of about 4,500.

The red colorant that is bleach stable which is used in the instant compositions is a ferric oxide (Fe203) red pigment sold by Bayer as Levanox Red 130LF01 red dispersion pigment of 60–65% Cl pigment. Red 101, silicon dioxide<3%, nonionic surfactant dispersant 5–10% and the balance being water. A solution of 98.7% of water, 0.8% Levanox Red 130 LFO1 dispersion and 0.5 of 50% sodium hydroxide aqueous solution is prepared and added to the liquid, gel automatic dishwashing composition.

Other conventional ingredients may be included in these compositions in small amounts, generally less than 3 weight percent, such as perfume, hydrotropic agents such as the sodium benzene, toluene, xylene and cumene sulphonates and preservatives, all of course being stable to chlorine bleach compound and high alkalinity.

The manner of formulating the invention compositions is also important. As discussed above, the order of mixing the ingredients as well as the manner in which the mixing is performed will generally have a significant effect on the properties of the composition, and in particular on product density (by incorporation and stabilization of more or less air) and physical stability (e.g. phase separation). Thus, according to the preferred practice of this invention the compositions are prepared by first forming a dispersion of the polyacrylic acid-type thickener and the low molecular weight noncrosslinked polyacrylate in water under moderate to high shear conditions, neutralizing the dissolved polymer to cause gelation and then introducing, while continuing mixing, the detergent builder salts, alkali metal dilicates, chlorine bleach compound and remaining detergent additives, including any previously unused alkali metal hydroxide, if any, other than the surface-active compounds. All of the additional ingredients can be added simultaneously or sequentially. Preferably, the ingredients are added sequentially, although it is not necessary to complete the addition of one ingredient before beginning to add the next ingredient. Furthermore, one or more of these ingredients can be divided into portions and added at different times. These mixing steps should also be performed under moderate to high shear rates to achieve complete and uniform mixing. These mixing steps may be carried out at room temperature, although the polymer thickener neutralization (gelation) is usually exothermic. The composition may be allowed to age, if necessary, to cause dissolved or dispersed air to dissipate out of the composition.

The remaining surface active ingredients, including the anti-foaming agent, organic detergent compound, and fatty acid or fatty acid salt stabilizer is post-added to the previously formed mixture in the form of an aqueous emulsion (using from about 1 to 10%, preferably from about 2 to 4% of the total water added to the composition other than water added as carrier for other ingredients or water of hydration) which is pre-heated to a temperature in the range of from Tm+5 to Tm−20, preferably from Tm to TM−10, where Tm is the melting point temperature of the fatty acid or fatty acid salt. For the preferred stearic acid stabilizer the heating temperature is in the range of 50° C. to 70° C. However, if care is taken to avoid excessive air bubble incorporation during the gelatin step or during the mixing of the detergent builder salts F203 (ferric oxide) red pigment and other additives, for example, by operating under vacuum, or using low shearing conditions, or special mixing operatatus, etc., the order of addition of the surface active ingredients should be less important.

The compositions will be supplied to the consumer in suitable dispenser containers preferably formed of molded plastic, especially polyolefin plastic, and most preferably polyethylene, for which the invention compositions appear to have particularly favorable slip characteristics. In addition to their linear viscoelastic character, the compositions of this invention may also be characterized as pseudoplastic gels (non-thixotropic) which are typically near the borderline between liquid and solid viscoelastic gel, depending, for example, on the amount of the polymeric thickener. The invention compositions can be readily poured from their containers without any shaking or squeezing, although squeezable containers are often convenient and accepted by the consumer for gel-like products.

The liquid, gelled automatic dishwasher compositions of this invention are readily employed in known manner for washing dishes, other kitchen utensils and the like in an automatic dishwasher, provided with a suitable detergent dispenser, in an aqueous wash bath containing an effective amount of the composition, generally sufficient to fill or partially fill the automatic dispenser cup of the particular machine being used.

The invention also provides a method for cleaning dishware in an automatic dishwashing machine with an aqueous wash bath containing an effective amount of the liquid, gelled automatic dishwasher detergent composition as described above. The composition can be readily poured from the polyethylene container with little or no squeezing or shaking into the dispensing cup of the automatic dishwashing machine and will be sufficiently viscous and cohesive to remain securely within the dispensing cup until shear forces are again applied thereto, such as by the water spray from the dishwashing machine.

The invention may be put into practice in various ways and a number of specific embodiments will be described to illustrate the invention with reference to the accompanying examples.

All the amounts and proportions referred to herein are by weight of the composition unless otherwise indicated.

EXAMPLE 1

The following formulations A-F were prepared as described below:

| INGREDIENT/FORMULATION | A | B | C | D | E | F |
|---|---|---|---|---|---|---|
| Sodium tripolyphosphate | 6 | 6 | 6 | 6 | 6 | |
| Sodium disilicate | 12 | 12 | 12 | 12 | 12 | |
| Potassium hydroxide | 3.89 | 3.89 | 3.89 | 3.89 | 3.89 | |
| Sodium hydroxide | 0.87 | 0.87 | 0.87 | 0.87 | 0.87 | 0.87 |
| Acusol 445N | 1.92 | 1.92 | 1.92 | 1.92 | 1.92 | |
| Carbopol 617 | 0.7 | 0.7 | 0.7 | 0.7 | 0.7 | 0.7 |
| Dowfax 3B2 | 0.23 | 0.23 | 0.23 | 0.23 | 0.23 | 0.23 |
| LPKn 158 | 0.16 | 0.16 | 0.16 | 0.16 | 0.16 | |
| Stearic acid | 0.11 | 0.11 | 0.11 | 0.11 | 0.11 | |
| Sodium hypochlorite (13% solution) | 9.2 | 9.2 | 9.2 | 9.2 | 9.2 | 9.2 |
| Perfume | 0.1 | 0.1 | 0.1 | 0.1 | 0.1 | |
| Water | Bal. | Bal. | Bal. | Bal. | Bal. | Bal. |
| Levanox Red Fe2O3 pigment (Cl pigment Red No. 1) | 0.002 | | | | | 0.002 |
| FD & C Red #3 | | 0.002 | | | | |
| Graphol Red 1116-2 | | | 0.002 | | | |
| Xylene Red B | | | | 0.002 | | |
| Vibracolor Red PRE5-L | | | | | 0.002 | |
| Color stability for 13 weeks at | | | | | | |
| 77° F. | | | | | | |
| 100° F. | | | | | | |
| CIE coordinates | | | | | | |
| x | 0.3192 | | | | | 0.3289 |
| y | 0.3283 | | | | | 0.3412 |
| CIE tresilicas values | | | | | | |
| X | 11.21 | | | | | 10.32 |
| Y | 11.53 | | | | | 10.70 |
| Z | 12.38 | | | | | 10.35 |
| CIELAB coordinates | | | | | | |
| a | 1.49 | | | | | |
| b | 0.00 | | | | | |

-continued

| INGREDIENT/FORMULATION | A | B | C | D | E | F |
|---|---|---|---|---|---|---|
| L | 33.96 | | | | | |
| h | 0.00 | | | | | |
| c | 1.49 | | | | | |

What is claimed is:

1. An aqueous liquid, pink colored, linear viscoelastic, automatic dishwasher detergent comprising approximately by weight:

(a) 5% to 40% of an inorganic compound containing alkali metal cations, wherein said inorganic compound is selected from the group consisting of alkali metal salts of tripolyphosphate, metaphosphate, pyrophosphate, hexa-metaphosphate, orthophosphate, carbonate, citrate, nitrilotriacetate, hydroxides, silicates and mixtures thereof;

(b) 0.05% to 2% chlorine bleach stable foam depressant selected from the group consisting of an alkyl acid phosphate ester, an alkyl phosphoric acid ester wherein said esters contain one or two C12–C20 alkyl groups, ethoxylated alkyl groups, and mixtures thereof;

(c) chlorine bleach compound in an amount to provide about 0.2 to 4% of available chlorine;

(d) 0.1% to 1.5% of a hydrophilic cross-linked polyacrylic acid thickening agent having a molecular weight from about 500,000 to 5,000,000;

(e) 0.001% to 0.5% of a red $Fe_2O_3$ pigment (f) 0.1% to 5% of an alkali metal mono- and/or di-($C_8$–$C_{11}$) alkyl diphenyl oxide mono- and/or di-sulphate;

(g) 0.1% to 4% of a non-crosslinked polyacrylate polymer having a molecular weight of from 2,000 to 20,000;

(h) 0.05% to 1% of a long chain fatty acid or a metal salt of a long chain fatty acid; and (i) the balance being water wherein the composition has chromaticity coordinate values of x from about 0.3142 to about 0.3300 and y from about 0.3233 to about 0.3450.

2. The composition of claim 1 in which the chlorine bleach compound is sodium hypochlorite.

* * * * *